United States Patent [19]

Thistlethwaite

[11] Patent Number: 4,576,791

[45] Date of Patent: Mar. 18, 1986

[54] ALUMINIUM-STRONTIUM-TITANIUM-BORON MASTER ALLOY

[75] Inventor: Stuart R. Thistlethwaite, Widnes, England

[73] Assignee: Anglo Blackwells Limited, England

[21] Appl. No.: 583,940

[22] Filed: Feb. 27, 1984

[51] Int. Cl.[4] ..... C22C 21/00

[52] U.S. Cl. ..... 420/552

[58] Field of Search ..... 420/552; 148/415, 437

[56] References Cited

U.S. PATENT DOCUMENTS 2,272,779 2/1942 Sarbey ..... 420/552

*Primary Examiner*—R. Dean

*Attorney, Agent, or Firm*—Scully, Scott, Murphy & Presser

[57] ABSTRACT

A master alloy for modifying the eutectic phase of an aluminium-silicon eutectic or hypo-eutectic casting alloy, and consisting essentially of, in weight percent: 4–20% strontium, 0.2–5% titanium, up to 1% boron, the balance being aluminium and impurities.

7 Claims, 4 Drawing Figures

ALUMINIUM-STRONTIUM-TITANIUM-BORON MASTER ALLOY

FIELD OF THE INVENTION

This invention relates to an aluminium-strontium-titanium-boron master alloy for use in modifying the aluminium silicon eutectic phase of aluminium-silicon eutectic or hypo-eutectic alloys to improve the casting and mechanical properties thereof.

BACKGROUND OF THE INVENTION

In the past sodium has been employed as a modifying agent for the aforesaid aluminium-silicon casting alloys. More recently strontium has been proposed instead of sodium because it gives a more permanent modifying effect than sodium. Such master alloys employing strontium are disclosed, for example, in British Patent Specification No. 1,514,503 which describes a strontium-silicon-aluminium master alloy and in U.S. Pat. No. 3,567,429 which describes master alloys containing strontium and/or barium for use as refining alloys for aluminium silicon alloys.

Strontium has hitherto generally been added to the aluminium-silicon melt in the furnace, either as metal or as a master alloy. Strontium oxidizes at normal aluminium casting temperatures, resulting in the need for relatively high additions of the metal which is relatively expensive. Moreover there is the likelihood of furnace contamination, and hydrogen pick-up in the furnace, occurring. Recently, attempts have been made to overcome these problems by introducing strontium as a low concentration master alloy in rod form into the launder immediately prior to casting. The main disadvantage of this method has been the relatively high addition rates which are required and this adds to the expense of the process. It has been found that higher concentration. Al-Sr master alloys in rod form (5–10% Sr) take 10–15 minutes to dissolve and therefore cannot be used as launder feeds.

The aluminium-silicon alloys are generally also treated with an aluminium-titanium boron alloy in either rod or ingot form for alloy grain refining the as-cast structure giving reductions in micro porosity, improved mechanical properties and improved surface finish. If both the aluminium-strontium containing master alloy and the aluminium-titanium-boron alloy are introduced in rod form then two rod feeding systems are required. Moreover the producton of the aforesaid strontium-containing master alloys in rod form has certain disadvantages, principally that segregation of the strontium phase tends to occur in the extruded billet, greatly limiting the concentration of strontium which can be used.

SUMMARY OF THE INVENTION

It is an object of the invention to provide an improved strontium-containing master alloy for modifying aluminium-silicon eutectic or hypo-eutectic alloys which reduces or obviates at least some of the above-mentioned disadvantages of prior art master alloys in rod form.

According to the invention, there is provided a master alloy for modifying the eutectic phase of an aluminium-silicon eutectic or hypo-eutectic casting alloy, and consisting essentially of, in weight percent: 4–20%, typically 4–15%, strontium, 0.2–5% titanium, up to 1% boron, the balance being aluminium and impurities normally found in aluminium.

A preferred master alloy according to the invention contains, in weight percent: 10% strontium, 0.5–2% titanium, 0.1–0.5% boron, the balance being aluminium and impurities.

A master alloy according to the invention in rod form can be introduced into the aluminium-silicon alloy when flowing in the launder from the furnace in which it is produced. Only one rod feeding unit is then required because a separate supply of aluminium-titanium-boron is no longer needed. Moreover it has been found that the ductility of the rod is improved allowing higher percentages of strontium to be used therein and segregation of the strontium phase is reduced in the extruded billet. Resulting from this, it has been found that higher strontium content rod can now be produced than could previously be produced for use in modifying Al-Si alloys flowing in launders.

A further advantage which has been found is an improved surface finish of the rod which reduces its tendency to fracture on cooling. Moreover the $SrAl_4$ intermetallic particle size is reduced which, inter alia, improves ductility and dissolution time.

It has also been proposed, e.g. in U.S. Pat. No. 3,926,690, to use strontium in wrought alloys to reduce "pick-up" on Al-Si-Mg extrusion alloys. Use of an Al-Sr-Ti-B alloy in accordance with the present invention in such a process would also be advantageous for similar reasons to those referred to above in connection with Al-Si alloys.

DETAILED DESCRIPTION

An Al-Sr-Ti-B master alloy in accordance with the invention is produced by melting aluminium, metallic strontium and an aluminium-titanium-boron alloy in an induction furnace to ensure a homogenous melt at temperatures between 1470° F. (800° C.) and 2000° F. (1100° C.) by normal procedures. It has been found that, at temperatures below this range, large $SrAl_4$ plates are present and, at temperatures above this range, the strontium tends to oxidize and large amounts of gas are absorbed which prevent a mechanically sound rod from being formed. The rod is extruded by conventional methods.

Figure 1:
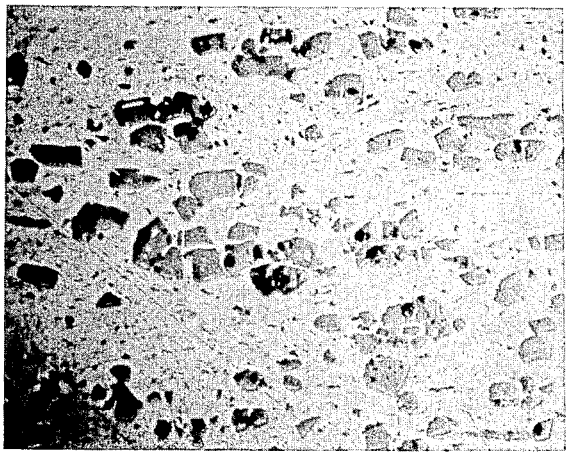
FIG. 1 is a photomicrograph of an Al, 10% Sr rod.
Figure 2:
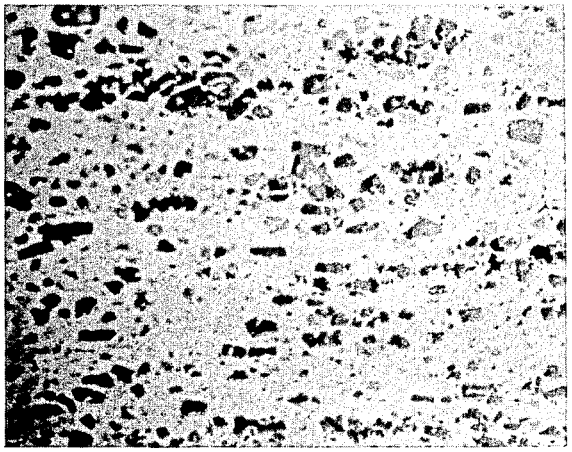
FIG. 2 is a photomicrograph of an Al-Sr-Ti-B rod in accordance with the present invention.

FIG. 2 is a photomicrograph of an Al-Sr-Ti(10%)-B(0.2%) rod made by this method having fine crystals of $SrAl_4$ and $TiAl_3$ of which the typical particle sizes of the $SrAl_4$ phase thereof are 20–100$\mu$. This can be compared with the photomicrograph of FIG. 1 of an Al-SR(10%) rod having relatively large crystals of $SrAl_4$ phase of which the typical particle sizes are 50–300$\mu$.

The mechanical property considered to be most suitable for measuring the suitability of the rod to be used in practice is its ability to bend, since the rod has to be coiling and then fed through a feeding system which requires the rod to be bent. The following results of bend tests compares this property of a rod in accordance with the invention with other Al-Sr master alloys in rod form:

| Alloy | Minimum Bend Diameter |
|---|---|
| Al—Sr(3.5%) | <2 ins. |
| Al—Sr(5%) | <2 ins. |
| Al—Sr(10%) | 6 ins. |
| Al—Sr(10%)—Ti(1%)—B(0.2%) | 2 ins. |

Figure 3:
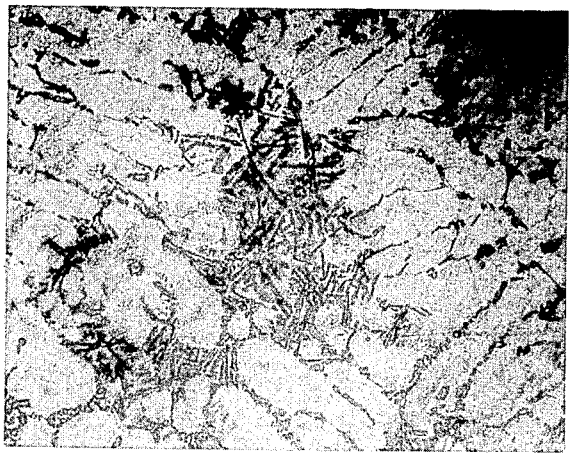
FIG. 3 is a photomicrograph of an Al, 7% Si, 0.3 Mg casting alloy which is unmodified: and, FIG. 4 is a photomicrograph of an Al, 7% Si, 0.3% Mg casting alloy modified and refined by an Al-Sr-Ti-B rod in accordance with the invention.
Figure 4:
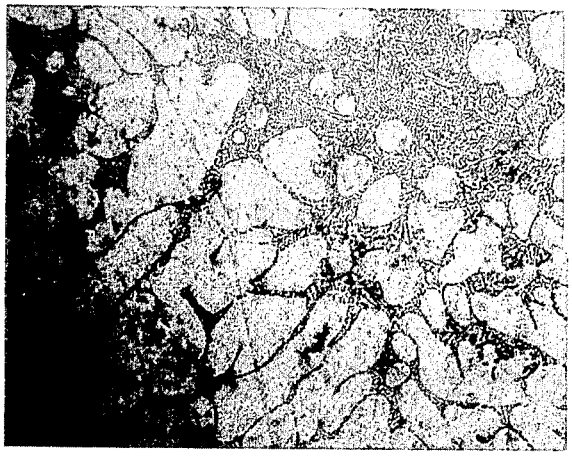

FIG. 4 is a photomicrograph of an Al-Si(7%)-Mg(0.3%) casting alloy, which is modified and refined by an Al-Sr-Ti-B rod in accordance with the invention one minute after addition of the rod at a rate of 0.2% (viz. 0.02% Sr). The alloy exhibits a fully refined structure with no undissolved $SrAl_4$ compound as compared with the unmodified alloy as shown in the photomicrograph thereof in FIG. 3.

The following is a table of results obtained from two test runs in which such as casting alloy is modified and refined by an Al-Sr-Ti-B rod in accordance with the invention:

| | 0.05% Sr | | 0.02% Sr | |
|---|---|---|---|---|
| | Sr Content | Addition Modification | Sr Content | Addition Modification |
| Before addition | <0.01 | unrefined | <0.01 | unrefined |
| 1 minute after addition | 0.048 | refined | 0.019 | refined |
| 5 minutes after addition | 0.048 | refined | 0.019 | refined |
| 30 minutes after | 0.046 | refined | 0.018 | refined |

EXAMPLE

A primary aluminium producer of an Al, 10% (by weight) Si casting alloy typically requires the addition of 0.02% (by weight) Sr to effect modification of the Al-Si eutectic phase. A master alloy in accordance with the invention containing Al, 10% Sr, 1% Ti, 0.2% B is added in rod form to the launder in which the above Al-Si alloy flows to give maximum dissolution of the rod therein prior to solidification of the Al-Si alloy in the cast ingot. The rod is added at 730° C. (1350° F.) and a typical Sr yield is 95% which is considerably higher than with furnace additions of Sr where the yield is generally in the range of 80–90%. A fully eutectic yield is achieved, which is retained on remelting. The yield of Ti and B is greater than 95% and grain refinement of the cast ingot is achieved.

I claim:

1. A master alloy for modifying the eutectic phase of an aluminium-silicon eutectic or hypo-eutectic casting alloy, or for treating an Al-Si-Mg extrusion alloy and consisting essentially of, in weight percent: 4–20% strontium, 0.2–5% titanium, boron in an amount up to 1%, the balance being aluminium and impurities.

2. A master alloy as claimed in claim 1 which contains 4–15% strontium.

3. A master alloy as claimed in claim 1 which contains 10% strontium.

4. A master alloy as claimed in claim 1 which contains 0.5–2% titanium.

5. A master alloy as claimed in claim 1 which contains 0.1–0.5% boron.

6. A master alloy as claimed in claim 1 which contains 10% strontium, 0.5–2% titanium, and 0.1–0.5% boron.

7. A master alloy as claimed in claim 1 in the form of a rod.

* * * * *